US010352028B2

(12) United States Patent
Boeltl et al.

(10) Patent No.: US 10,352,028 B2
(45) Date of Patent: Jul. 16, 2019

(54) WASTE RECEPTACLE SYSTEMS AND METHODS

(71) Applicant: Acorn Engineering Company, City of Industry, CA (US)

(72) Inventors: Darryl Boeltl, Whittier, CA (US); Keith Marshall, Rancho Cucamonga, CA (US); Laura Marshall, Rancho Cucamonga, CA (US); Don Morris, Newport Coast, CA (US); Tom Zinn, Chino Hills, CA (US)

(73) Assignee: Acorn Engineering Company, City of Industry, CA (US)

( * ) Notice: Subject to any disclaimer, the term of this patent is extended or adjusted under 35 U.S.C. 154(b) by 17 days.

(21) Appl. No.: 15/196,235

(22) Filed: Jun. 29, 2016

(65) Prior Publication Data

US 2016/0376779 A1 Dec. 29, 2016

Related U.S. Application Data

(60) Provisional application No. 62/231,277, filed on Jun. 29, 2015.

(51) Int. Cl.

| | |
|---|---|
| ***E03D 5/01*** | (2006.01) |
| ***E03D 11/11*** | (2006.01) |
| ***E03D 1/24*** | (2006.01) |

(52) U.S. Cl.

CPC ..... *E03D 5/01* (2013.01); *E03D 1/24* (2013.01); *E03D 11/11* (2013.01); *E03D 2201/30* (2013.01)

(58) Field of Classification Search

CPC .. E03D 1/12; E03D 1/38; E03D 11/10; E03D 11/18; E03D 2201/00; E03D 2201/30; E03D 5/00; E03D 5/01

USPC ..... 4/368–374, 417, 425, 431–433

See application file for complete search history.

(56) References Cited

U.S. PATENT DOCUMENTS 2,415,762 A * 2/1947 Kivela ..... B65H 20/02 101/228
2,915,762 A * 12/1959 Kivela ..... A47K 1/14 220/315
3,663,970 A * 5/1972 Drouhard, Jr. ..... E03F 1/006 4/319
4,319,366 A * 3/1982 Baker, Jr. ..... B63B 29/14 4/321

(Continued)

FOREIGN PATENT DOCUMENTS

KR 101479164 * 12/2014 ..... E03D 3/10

*Primary Examiner* — David P Angwin
*Assistant Examiner* — Nicholas A Ros
(74) *Attorney, Agent, or Firm* — Eric J. Sosenko; Jonathan P. O'Brien; Honigman LLP

(57) ABSTRACT

A toilet assembly is provided and includes an inlet conduit, a waste conduit, a flush-assist subsystem, and a plug. The waste conduit is configured to fluidly communicate with the inlet conduit. The flush-assist subsystem includes a flush-assist inlet and a flush-assist outlet. The flush-assist inlet is configured to fluidly communicate with the inlet conduit. The flush-assist outlet is configured to fluidly communicate with the waste conduit. The plug is disposed within the flush-assist subsystem and configured to prevent fluid communication between the inlet conduit and the waste conduit through the flush-assist subsystem.

19 Claims, 5 Drawing Sheets

(56) References Cited

U.S. PATENT DOCUMENTS

| | | | | | |
|---|---|---|---|---|---|
| 5,067,181 | A * | 11/1991 | Hafner | E03D 5/00 | 4/425 |
| 5,204,999 | A * | 4/1993 | Makita | E03D 5/00 | 4/300 |
| 6,000,070 | A * | 12/1999 | Bonin | E03D 9/05 | 4/252.3 |
| 6,453,481 | B1 * | 9/2002 | Pondelick | B64D 11/02 | 137/565.23 |
| 8,359,679 | B2 * | 1/2013 | Martin | E03D 9/00 | 4/255.01 |
| 8,756,722 | B2 * | 6/2014 | Inglin | E03D 11/08 | 4/420 |
| 2013/0312173 | A1 * | 11/2013 | Wu | E03D 11/18 | 4/422 |
| 2016/0024774 | A1 * | 1/2016 | Stack | E03D 11/02 | 4/420 |

* cited by examiner

WASTE RECEPTACLE SYSTEMS AND METHODS

CROSS-REFERENCE TO RELATED APPLICATIONS

This application claims priority under 35 U.S.C. § 119(e) to U.S. Provisional Application 62/231,277, filed on Jun. 29, 2015, the entire contents of which are incorporated herein by reference.

FIELD

The present disclosure relates to a waste receptacle system and more particularly to a method of retrofitting a waste receptacle system.

BACKGROUND

This section provides background information related to the present disclosure and is not necessarily prior art.

Waste receptacles, such as toilets, are used to transport and dispose of human waste. In this regard, known toilets include a bowl and a drain or port. Waste can be collected in the bowl and evacuated through the drain or port. In a gravity-assist toilet, water can be supplied to the bowl to assist with the evacuation of waste from the bowl and through the drain or port. In a vacuum-assist toilet, the evacuation of waste from the bowl and through the drain or port can be assisted or otherwise facilitated by the application of a vacuum to the drain or port. While conventional waste receptacles and related systems and methods may have proven useful for their intended purposes, a continuous need for improvement in the relevant art remains.

DRAWINGS

The drawings described herein are for illustrative purposes only of selected configurations and are not intended to limit the scope of the present disclosure.

Corresponding reference numerals indicate corresponding parts throughout the drawings.

SUMMARY

Figure 1A:
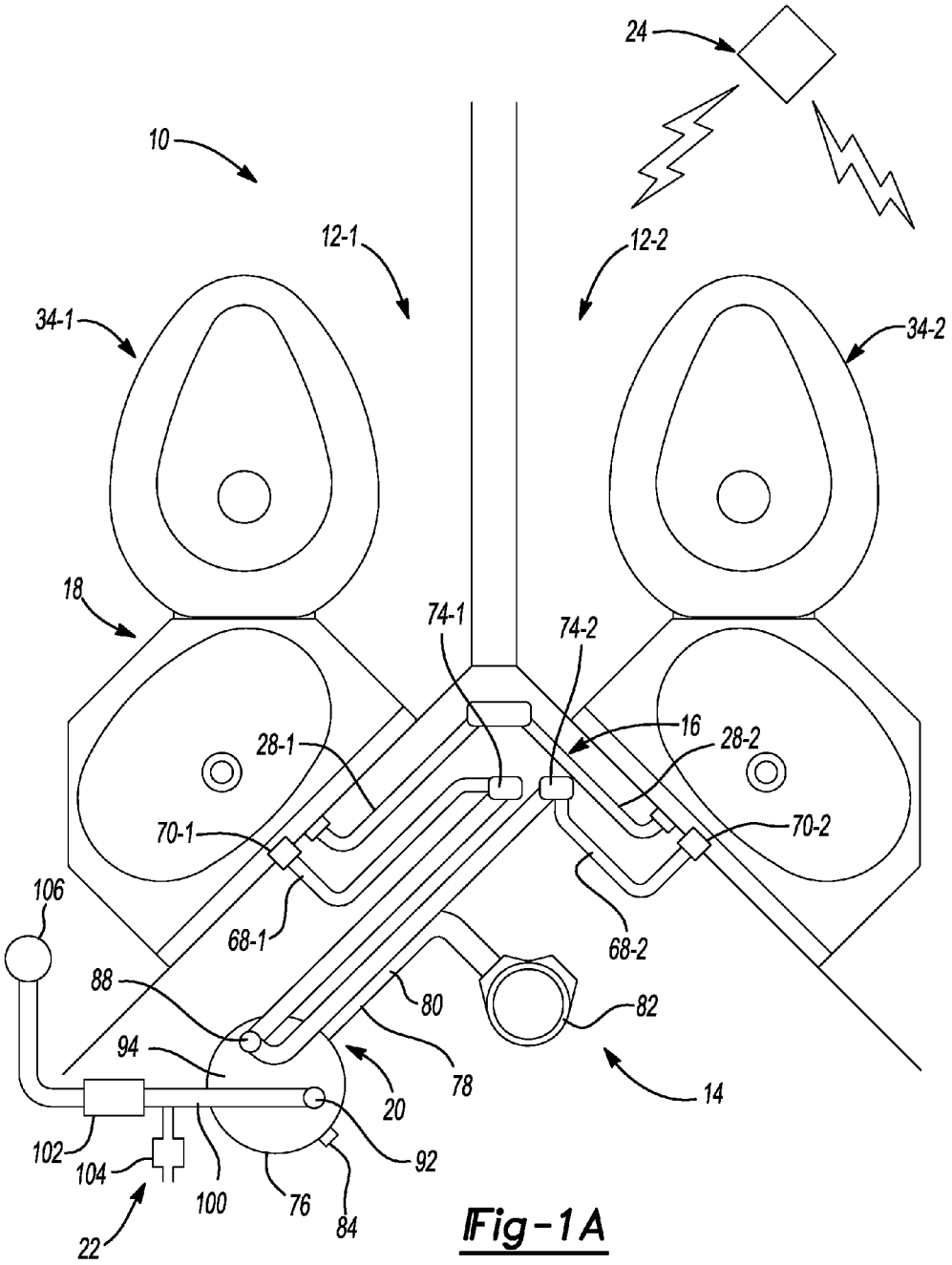
FIG. 1A is a schematic plan view of a waste receptacle system in accordance with the principles of the present disclosure.

This section provides a general summary of the disclosure, and is not a comprehensive disclosure of its full scope or all of its features.

In some aspects of the present disclosure, a toilet assembly is provided. The toilet assembly may include an inlet conduit, a waste conduit, a flush-assist subsystem, and a plug. The waste conduit is configured to fluidly communicate with the inlet conduit. The flush-assist subsystem includes a flush-assist inlet and a flush-assist outlet. The flush-assist inlet is configured to fluidly communicate with the inlet conduit. The flush-assist outlet is configured to fluidly communicate with the waste conduit. The plug is disposed within the flush-assist subsystem and configured to prevent fluid communication between the inlet conduit and the waste conduit through the flush-assist subsystem.

In some implementations, the flush-assist subsystem includes a flush-assist conduit having an inner surface. The plug may be sealingly engaged with the inner surface. In some implementations, the plug includes at least one of metal, elastomer, ceramic, mortar, and plaster. The plug may be disposed proximate the flush-assist inlet or the flush-assist outlet.

In some implementations, the toilet assembly includes a bowl having an outlet port in fluid communication with the waste conduit, the flush-assist outlet disposed downstream of the outlet port. In other implementations, the toilet assembly includes a bowl having an outlet port in fluid communication with the waste conduit, the flush-assist outlet disposed upstream of the outlet port.

In some implementations, the plug is removably disposed within the flush-assist subsystem.

In other aspects of the present disclosure, a vacuum plumbing system is provided. The vacuum plumbing system may include a vacuum pump, a waste discharge conduit, a waste container, and a toilet. The waste container may be in fluid communication with the vacuum pump and the waste discharge conduit. The toilet may include an inlet conduit, a waste conduit, a flush-assist conduit, and a plug. The waste conduit may be in fluid communication with the inlet conduit and the waste container. The flush-assist conduit may include a flush-assist inlet and a flush-assist outlet. The flush-assist inlet may be configured to fluidly communicate with the inlet conduit. The flush-assist outlet may be configured to fluidly communicate with the waste conduit. The plug may be disposed within the flush-assist conduit and configured to prevent fluid communication between the inlet conduit and the waste conduit through the flush-assist conduit.

In other aspects of the present disclosure, a method of retrofitting a toilet is provided. The toilet may include a fluid inlet, a fluid outlet, and a flush-assist subsystem in fluid communication with the fluid inlet and the fluid outlet. The flush-assist subsystem may include a flush-assist inlet and a flush-assist outlet. The method may include preventing fluid communication between the flush-assist outlet and the fluid outlet.

In some implementations, preventing fluid communication between the flush-assist outlet and the fluid outlet includes inserting a plug within the flush-assist subsystem to prevent fluid communication between the flush-assist inlet and the flush-assist outlet.

In some implementations, the method includes decoupling the fluid outlet from a waste discharge conduit.

In some implementations, the method includes fluidly coupling the fluid outlet to a waste container. The method may also include fluidly coupling the waste container to the waste discharge conduit.

The details of one or more implementations of the disclosure are set forth in the accompanying drawings and the description below. Other aspects, features, and advantages will be apparent from the description and drawings, and from the claims.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 1B:
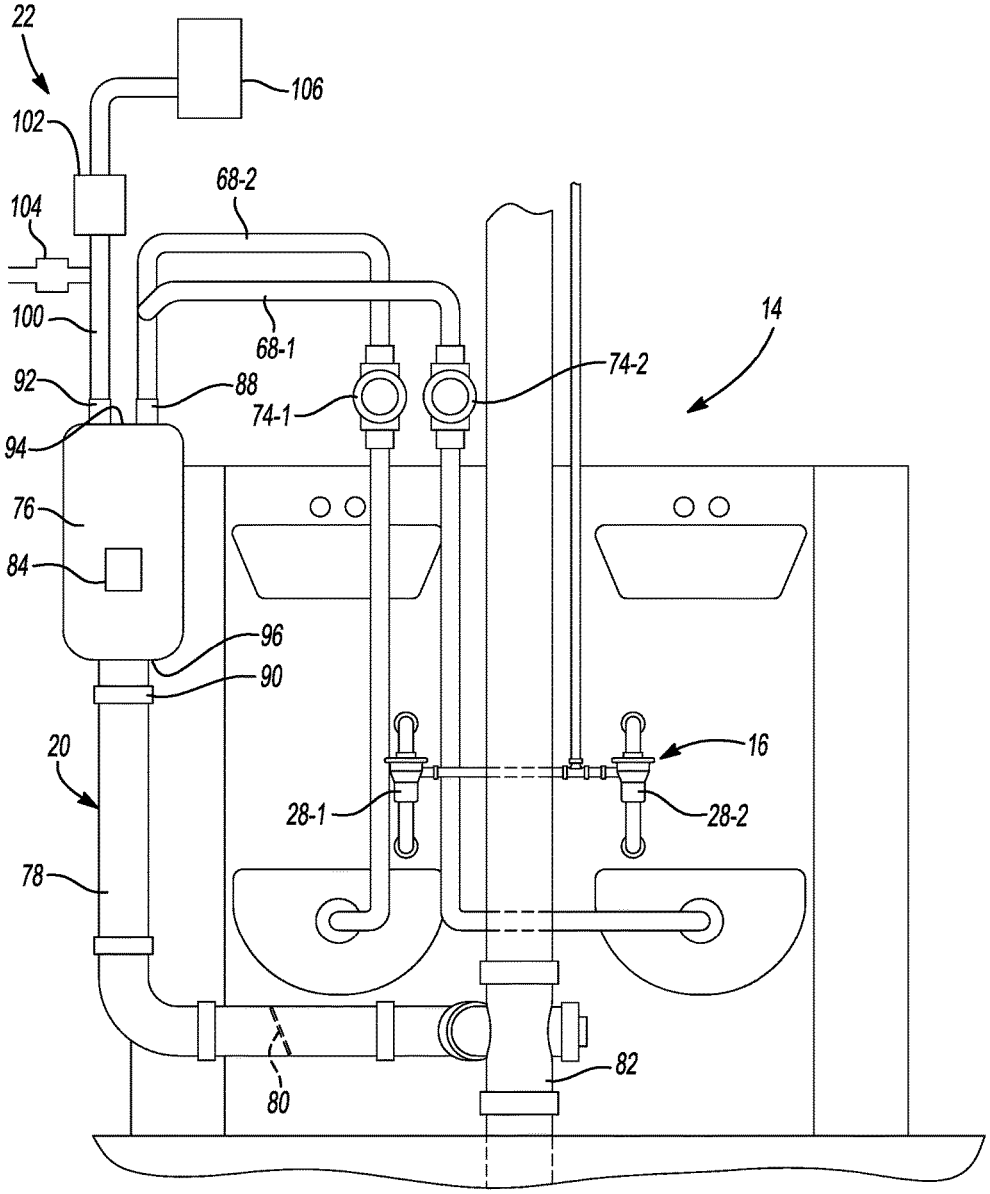
FIG. 1B is a schematic elevation view of the waste receptacle system of FIG. 1A.

With reference to FIGS. 1A and 1B, a facility 10 is provided. In some implementations, the facility 10 may include a prison. It will be appreciated, however, that the facility 10 may include other types of buildings within the scope of the present disclosure. The facility 10 may include one or more rooms 12-1, 12-2, . . . **12-*n* and a waste system 14**.

The waste system 14 may include a fluid supply system 16, a collection system 18, a conveyance system 20, a vacuum system 22, and a control system 24. As will be explained in more detail below, the collection system 18 may be in fluid communication with the fluid supply system 16, the conveyance system 20, and the vacuum system 22 to transport waste and other material (e.g., water, air, etc.) from the collection system 18 to the conveyance system 20. The control system 24 may be in communication with the collection system 18, the conveyance system 20, and the vacuum system 22 to control (i) the removal of waste and other material from the collection system 18 and (ii) the conveyance of waste and other materials through the conveyance system 20.

With reference to FIGS. 1A-3, the fluid supply system 16 may include one or more conduits 28-1, 28-2, . . . **28-*n*, one or more valves (e.g., flushometers) 30-1, 30-2, . . . 30-*n*, and one or more valve interfaces 32-1, 32-2, . . . 32-*n*. Each of the conduits 28-1, 28-2, . . . 28-*n* may be in fluid communication with the collection system 18. In this regard, in some implementations, the one or more conduits 28-1, 28-2, . . . 28-*n* supply water from a source (e.g., a well, a reservoir, etc.) to the collection system 18 through a respective one of the valves 30-1, 30-2, . . . 30-*n*. In some configurations, one or more of the valves 30-1, 30-2, . . . 30-*n* may be a low-volume fluid-supply valve. For example, one or more of the valves 30-1, 30-2, . . . 30-*n* may be operable to supply between 0.3 and 1.0 gallons of water per cycle. In some implementations, each of the valves 30-1, 30-2, . . . 30-*n* may supply 0.75 gallons of water per cycle, where a cycle may be measured by the amount of time the valve 30-*n* is opened before being closed. In this regard, in the context of the fluid supply system 16**, a cycle may be referred to as a flush cycle.

The valve interface 32-1, 32-2, . . . **32-*n* may include a button, a lever, a switch, or any other suitable mechanical or electrical device for controlling a position (e.g., open or closed) of the valves 30-1, 30-2, . . . 30-*n*. In this regard, in some implementations, the valves 30-1, 30-2, . . . 30-*n* may be in communication with the control system 24 to control the position of the valves 30-1, 30-2, . . . 30-*n***.

The collection system 18 may include one or more collection reservoirs 34-1, 34-2, . . . **34-*n* in fluid communication with the fluid supply system 16 and the vacuum system 22. For example, each collection reservoir 34-1, 34-2, . . . 34-*n* may be in fluid communication with a respective one of the conduits 28-1, 28-2, . . . 28-*n*. In some implementations, at least one of the collection reservoirs 34-1, 34-2, . . . 34-*n* may include a toilet. In this regard, the collection reservoirs 34-1, 34-2, . . . 34-*n* will be referred to herein as the toilets 34-1, 34-2, . . . 34-*n*. It will be appreciated, however, that the collection reservoirs 34-1, 34-2, . . . 34-*n*** may include other types of fluid collection reservoirs (e.g., sinks, showers, tubs, etc.) within the scope of the present disclosure.

Figure 3:
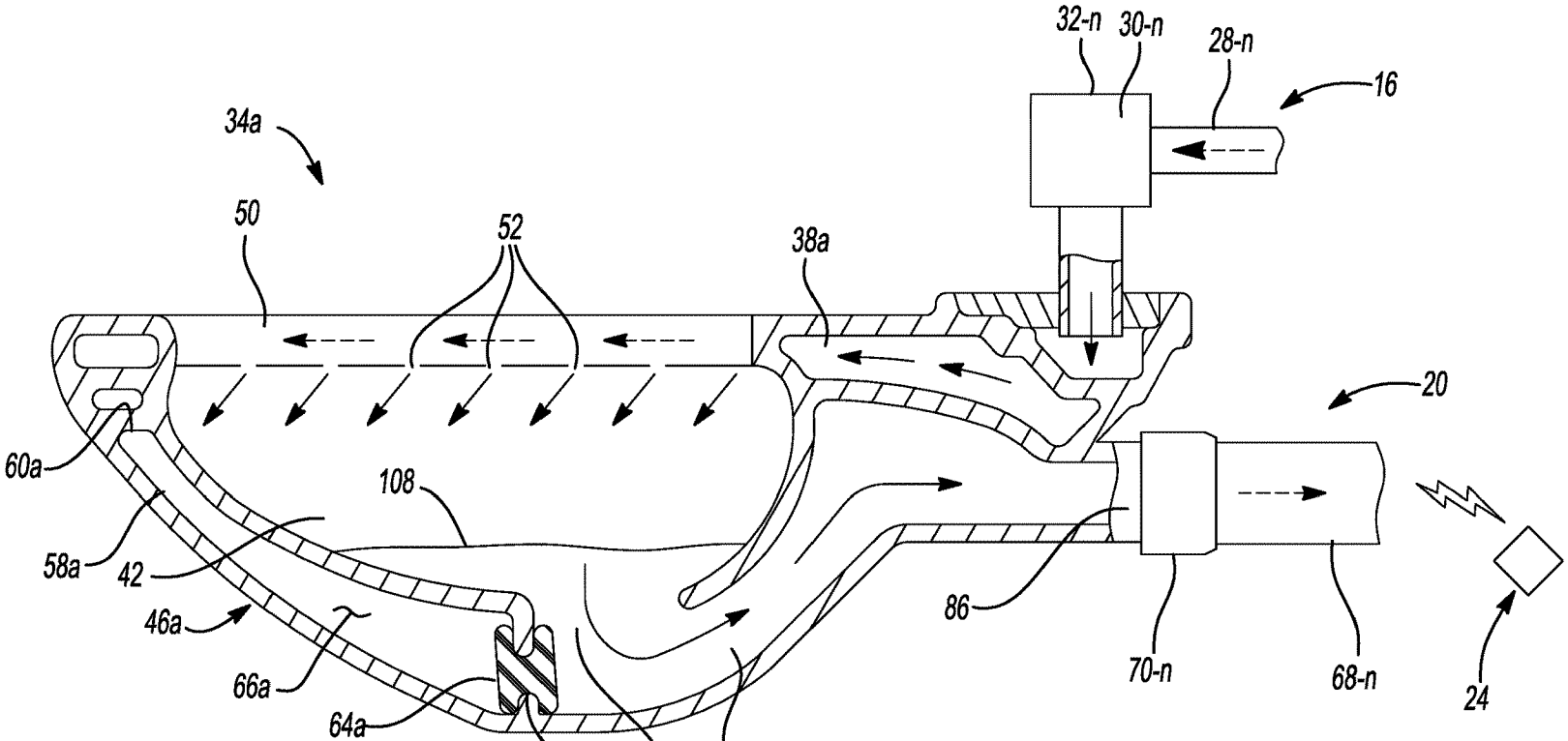
FIG. 3 is a cross-sectional view of another waste receptacle in accordance with the principles of the present disclosure.

With reference to FIG. 3, each toilet 34-1, 34-2, . . . **34-*n* may include a fluid inlet 38, a rim 40, a bowl 42, a waste conduit 44, a flush assist subsystem 46, and a fluid outlet 48. As will be explained in more detail below, the fluid inlet 38 may be in fluid communication with the fluid supply system 16, and the fluid outlet 48 may be in fluid communication with the conveyance system 20, in order to convey fluid (e.g., water) from the fluid supply system 16 to the toilet 34-1, 34-2, . . . 34-*n* and from the toilet 34-1, 34-2, . . . 34-*n*** to the conveyance system 20, respectively. In some implementations, the toilet 34-1, 34-2, . . . **34-*n*** may include, or otherwise be formed from, a metal such as stainless steel, for example.

The rim 40 may include a fluid passage 50 and one or more apertures 52. The fluid passage 50 may be in fluid communication with the fluid inlet 38 and with the one or more apertures 52 in order to convey fluid from the fluid inlet 38 to the bowl 42 through the rim 40. The bowl 42 may include a chamber 54 and a port 56 (e.g., aperture). The port 56 may be in fluid communication with the chamber 54 and the waste conduit 44 to convey fluid (e.g., water and/or waste) from the chamber 54 to the waste conduit 44 through the bowl 42. The waste conduit 44 may be in fluid communication with the port 56 and the fluid outlet 48, and the fluid outlet 48 may be in fluid communication with the conveyance system 20. In this regard, the waste conduit 44 may convey fluid from the bowl 42 to the conveyance system 20 through the fluid outlet 48.

Figure 2:
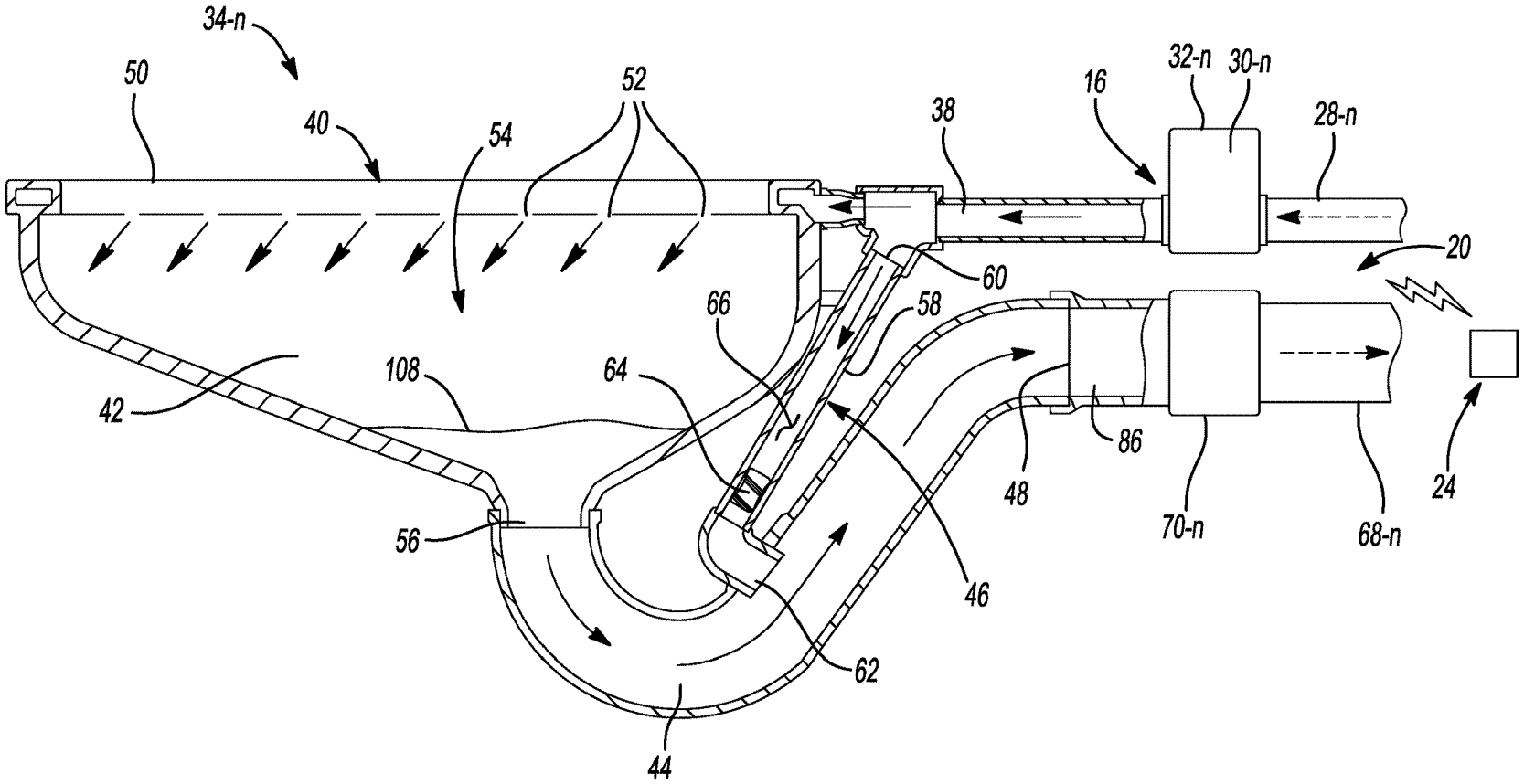
FIG. 2 is a cross-sectional view of a waste receptacle in accordance with the principles of the present disclosure.

The flush assist subsystem 46 may include a flush assist conduit 58, a flush assist inlet 60, a flush assist outlet 62, and a plug 64. The flush assist conduit 58 may be defined by an inner surface 66 extending from the fluid supply system 16 to the waste conduit 44 and/or to the conveyance system 20. As illustrated in FIG. 2, in some implementations, the flush assist conduit 58 may extend from the fluid inlet 38 to the waste conduit 44, such that (i) the flush assist inlet 60 is in fluid communication with the fluid inlet 38 and (ii) the flush assist outlet 62 is in fluid communication with the waste conduit 44. For example, the flush assist inlet 60 may be in fluid communication with the fluid inlet 38, upstream of the apertures 52, and the flush assist outlet 62 may be in fluid communication with the waste conduit 44, downstream of the port 56.

The plug 64 may be disposed within at least one of the flush assist conduit 58, the flush assist inlet 60, and the flush assist outlet 62 in order to inhibit, or otherwise prevent, fluid communication between the fluid supply system 16 and the fluid conveyance system 20 through the flush assist subsystem 46. For example, the plug 64 may be disposed within the flush assist conduit 58 to prevent fluid communication between the flush assist inlet 60 and the flush assist outlet 62 through the flush assist conduit 58. In this regard, the plug 64 may be sealingly engaged with the inner surface 66 of the flush assist conduit 58. In some implementations, the plug 64 may include any suitable material, including, for example, metal, (e.g., steel, brass, iron, etc.), elastomer (e.g., rubber, polyurethane, etc.), ceramic, mortar, or plaster. In particular, the plug 64 may be constructed at least in part from a first material, while the flush assist conduit 58 and/or the inner surface 66 may be constructed at least in part from a second material that is different than the first material. In some implementations, the plug 64 may be permanently disposed within the flush assist subsystem 46. For example, in some implementations, the plug 64 is bonded (e.g., adhesive, weld, etc.) to the inner surface 66 of the flush assist conduit 58. In other implementations, the plug 64 may be removably disposed within the flush assist subsystem 46. For example, the plug 64 may sealingly engage the inner surface 66 of the flush assist conduit 58 in a press-fit configuration.

While the plug 64 is generally shown and described herein as preventing fluid communication between the flush assist outlet 62 and the waste conduit 44, it will be appreciated that fluid communication between the flush assist outlet 62 and the waste conduit 44 may be inhibited, or otherwise prevented, using other suitable techniques. For example, in some implementations the flush assist subsystem 46 may include a cover (e.g., a cover proximate the flush assist inlet 60 and/or proximate the flush assist outlet 62) or a valve to prevent fluid communication between the waste conduit 44 and the fluid supply system 16 downstream of the port 56.

With reference to FIG. 3, another toilet **34*a* for use with the waste system 14 is provided. The toilet 34*a* may be substantially similar to the one or more toilets 34-1, 34-2, . . . 34-*n*. Accordingly, like reference numerals are used hereinafter and in the drawings to identify like components, while like reference numerals containing letter extensions (i.e., "a") are used to identify those components that have been modified. In some implementations, the toilet 34*a*** may include, or otherwise be formed from one of ceramic, porcelain, and china (e.g., vitreous china), for example.

Each toilet **34*a* may include a flush assist subsystem 46*a* having a flush assist conduit 58*a*, a flush assist inlet 60*a*, a flush assist outlet 62*a*, and a plug 64*a*. The flush assist conduit 58*a* may be defined by an inner surface 66*a* extending from the fluid supply system 16*a* to the waste conduit 44*a* and/or to the conveyance system 20. As illustrated in FIG. 3, in some implementations, the flush assist conduit 58*a* may extend from the fluid passage 50 to the waste conduit 44, such that (i) the flush assist inlet 60*a* is in fluid communication with the fluid passage 50 and (ii) the flush assist outlet 62*a* is in fluid communication with the waste conduit 44. For example, the flush assist inlet 60*a* may be in fluid communication with the fluid passage 50 downstream of the fluid inlet 38, and the flush assist outlet 62*a* may be in fluid communication with the waste conduit 44*a* upstream of the port 56**.

The plug **64*a* may be disposed within at least one of the flush assist conduit 58*a*, the flush assist inlet 60*a*, and the flush assist outlet 62*a* in order to inhibit, or otherwise prevent, fluid communication between the fluid supply system 16 and the fluid conveyance system 20 through the flush assist subsystem 46*a*. For example, the plug 64*a* may be disposed within the flush assist conduit 58*a* to prevent fluid communication between the flush assist inlet 60*a* and the flush assist outlet 62*a* through the flush assist conduit 58*a*. In this regard, the plug 64*a* may be sealingly engaged with the inner surface 66*a* of the flush assist conduit 58*a*. In some implementations, the plug 64*a* may include any suitable material, such as metal, (e.g., steel, brass, iron, etc.), elastomer (e.g., rubber, polyurethane, etc.), ceramic, mortar, or plaster, for example. In particular, the plug 64*a* may be constructed at least in part from a first material, while the flush assist conduit 58*a* and/or the inner surface 66*a* may be constructed at least in part from a second material that is different than the first material. In some implementations the plug 64*a* may be permanently disposed within the flush assist subsystem 46*a*. For example, in some implementations, the plug 64*a* is bonded (e.g., adhesive, weld, etc.) to the inner surface 66*a* of the flush assist conduit 58*a*. In other implementations, the plug 64*a* may be removably disposed within the flush assist subsystem 46*a*. For example, the plug 64*a* may sealingly engage the inner surface 66*a* of the flush assist conduit 58*a*** in a press-fit configuration.

While the plug **64*a* is generally shown and described herein as preventing fluid communication between the flush assist outlet 62*a* and the waste conduit 44*a*, it will be appreciated that fluid communication between the flush assist outlet 62*a* and the waste conduit 44*a* may be inhibited, or otherwise prevented, using other suitable techniques. For example, in some implementations the flush assist subsystem 46*a* may include a cover (e.g., a cover proximate the flush assist inlet 60***a* and/or proximate the flush assist outlet 62*a*) or a valve to prevent fluid communication between the waste conduit 44*a* and the fluid supply system 16 upstream of the port 56.

With reference to FIGS. 1A-3, the conveyance system 20 may include a one or more conduits 68-1, 68-2, . . . 68-*n*, one or more pressure relief mechanisms 70-1, 70-2, . . . 70-*n*, one or more waste extraction valves 74-1, 74-2, . . . 74-*n*, a waste container 76, a first waste discharge conduit 78, a check valve 80, a second waste discharge conduit 82, and a sensor 84. Each of the conduits 68-1, 68-2, . . . 68-*n* may be in fluid communication with a waste conduit 44 of one of the toilets 34-1, 34-2, . . . 34-*n*. In this regard, each conduit 68-1, 68-2, . . . 68-*n* may include an adapter 86 to fluidly couple the conduit 68-1, 68-2, . . . 68-*n* to the waste conduit 44 of one of the toilets 34-1, 34-2, . . . 34-*n*. Each pressure relief mechanism 70-1, 70-2, . . . 70-*n* may be disposed within, and/or coupled to, one of the conduits 68-1, 68-2, . . . 68-*n* to control (e.g., increase) the pressure in a corresponding one of the toilets 34-1, 34-2, . . . 34-*n*. For example, each pressure relief mechanism 70-1, 70-2, . . . 70-*n* may include a valve, an aperture, a conduit, or any other suitable mechanism in fluid communication with (i) the atmosphere and atmospheric pressure in the facility 10 and (ii) the corresponding conduit 68-1, 68-2, . . . 68-*n* and/or the corresponding one of the toilets 34-1, 34-2, . . . 34-*n*. In this regard, the pressure relief mechanism 70-1, 70-2, . . . 70-*n* may prevent the pressure in the toilets 34-1, 34-2, . . . 34-*n* (e.g., in the chamber 54) from being less than a predetermined value.

Each waste extraction valve 74-1, 74-2, . . . 74-*n* may include an interface (not shown), such as a button, a switch, or other suitable control mechanism, and may be disposed within one of the conduits 68-1, 68-2, . . . 68-*n* to control the removal of waste from a corresponding one of the toilets 34-1, 34-2, . . . 34-*n*. In particular, one or more of the waste extraction valves 74-1, 74-2, . . . 74-*n* may be opened to allow the vacuum system 22 to fluidly communicate with a corresponding one or more of the toilets 34-1, 34-2, . . . 34-*n* (e.g., the waste conduit 44 and/or the conduits 68-1, 68-2, . . . 68-*n*), while another one or more of the waste extraction valves 74-1, 74-2, . . . 74-*n* may be closed to prevent the vacuum system 22 from fluidly communicating with a corresponding one or more of the toilets 34-1, 34-2, . . . 34-*n* (e.g., the waste conduit 44 and/or the conduits 68-1, 68-2, . . . 68-*n*).

With reference to FIGS. 1A and 1B, the waste container 76 may include a waste inlet 88, a waste outlet 90, and a vacuum outlet 92. The waste inlet 88 may be in fluid communication with the conduits 68-1, 68-2, . . . 68-*n* to selectively transport waste from the toilets 34-1, 34-2, . . . 34-*n* to the waste container 76. In some implementations, the waste inlet 88 may be disposed proximate an upper portion 94 (e.g., the top, relative to the ground) of the waste container 76 such that fluid and waste flowing from the conduits 68-1, 68-2, . . . 68-*n* to the waste container 76 are forced to a lower portion 96 of the waste container 76 by gravity. In this way, the waste container 76 can separate the waste transported by the conduits 68-1, 68-2, . . . 68-*n* from the air transported by the vacuum system 22.

The waste outlet 90 may be in fluid communication with the waste container 76 and the first waste discharge conduit 78 to selectively transport waste from the waste container 76 to the first waste discharge conduit 78. As illustrated, the waste outlet 90 may be disposed proximate the lower portion 96 (e.g., the bottom, relative to the ground) of the waste container 76. In this regard, the check valve 80 may be disposed within one of the first waste discharge conduit 78 and the second waste discharge conduit 82 to control the flow of waste from the waste container 76 and the first waste discharge conduit 78 to the second waste discharge conduit 82 (e.g., sewer pipe). As will be explained in more detail below, in some implementations, the check valve 80 may move from a closed state (e.g., preventing fluid communication between the tank 76 and the discharge conduit 82) to an open state (e.g., allowing fluid communication between the tank 76 and the discharge conduit 82) in response to the waste container 76 accumulating, or otherwise containing, a predetermined amount (e.g., volume, mass, etc.) of waste, thereby allowing the waste to flow from the waste container 76 to the first and second waste discharge conduits 78, 82. In this regard, when the sensor 84 determines that the waste container 76 contains a predetermined amount (e.g., volume) of waste, the control system 24 may expose an interior volume of the waste container 76 to atmospheric pressure in a manner further described below, thereby opening the check valve 80 and allowing the waste to flow under the force of gravity from the waste container 76 to the first and second waste discharge conduits 78, 82.

The vacuum outlet 92 may be in fluid communication with the waste container 76 and the vacuum system 22 to selectively transport air from the waste container 76 to the vacuum system 22. In some implementations, the vacuum outlet 92 may be disposed proximate the upper portion 94 of the waste container 76 such that the waste container 76 can separate the waste transported by the conduits 68-1, 68-2, . . . 68-*n* from the air transported by the vacuum system 22.

The vacuum system 22 may include a vacuum conduit 100, an isolation valve 102, a vent valve 104, and a vacuum pump 106. The vacuum conduit 100 may be in fluid communication with the vacuum outlet 92 and the vacuum pump 106 to selectively transport fluid (e.g., air) from the waste container 76 to the vacuum pump 106. In this regard, activating the vacuum pump 106 reduces the pressure within the waste container 76 by extracting fluid (e.g., air) from the waste container 76. Accordingly, upon actuation of one or more of the waste extraction valves 74-1, 74-2, . . . 74-*n* and/or one or more of the valves 30-1, 30-2, . . . 30-*n*, exposure of the chamber 54, the port 56, and/or contents 108 therein (e.g., water, waste, air, etc.), to a pressure (e.g., atmospheric pressure) that is greater than the pressure within the waste container 76 causes the extraction of the contents 108 through the the corresponding conduit 68-1, 68-2, . . . 68-*n* and waste inlet 88 and into the waste container 76.

The isolation valve 102 and the vent valve 104 may each be coupled to the vacuum conduit 100. In this regard, the isolation valve 102 may be in fluid communication with the waste container 76 and the vacuum pump 106, and the vent valve 104 may be in fluid communication with the waste container 76 and the surrounding atmosphere. In some implementations, the isolation valve 102 may be disposed downstream of the vacuum outlet 92 and upstream of the vacuum pump 106, such that the isolation valve 102 prevents fluid communication between the vacuum pump 106 and the waste container 76 when the isolation valve 102 is in a closed position, and allows fluid communication between the vacuum pump 106 and the waste container 76 when the isolation valve 102 is in an open position. In this regard, the portion of the vacuum conduit 100 disposed downstream of the isolation valve 102 may be exposed to vacuum pressure when the vacuum pump 106 is operating and when the isolation valve is in a closed position or an open position, while the portion of the vacuum conduit 100 disposed upstream of the isolation valve 102 may be (i)

exposed to vacuum pressure when the vacuum pump 106 is operating and when the isolation valve 102 is in an open position and (ii) exposed to a pressure greater than vacuum pressure (e.g., atmospheric pressure) when the vacuum pump 106 is operating and when the isolation valve is in a closed position. The vent valve 104 may be disposed downstream of the vacuum outlet 92 and upstream of the isolation valve 102, such that the vent valve 104 prevents fluid communication between the waste container 76 and the atmosphere when the vent valve 104 is in a closed position, and allows fluid communication between the waste container 76 and the atmosphere when the vent valve 104 is in an open position.

The control system 24 may include a server 110, a link 112, and one or more valve control modules 114-1, 114-2, . . . **114-*n*. The control system 24 may be in wired or wireless communication with the valves 30-1, 30-2, . . . 30-*n*, the valve interfaces 32-1, 32-2, . . . 32-*n*, the waste extraction valves 74-1, 74-2, . . . 74-*n*, the sensor 84, the isolation valve 102, and the vent valve 104 to control the flow of waste (i) from the toilets 34-1, 34-2, . . . 34-*n* to the waste container 76, and (ii) from the waste container 76 to the second waste discharge conduit 82. The server 110 may be implemented in a number of different forms. For example, the server 110** may be implemented as a standard server or multiple times in a group of such servers, such as a laptop computer, a desktop computer, or as part of a rack server system.

As will be explained in more detail below, the server 110 may communicate through the link 112 with the one or more valve control modules 114-1, 114-2, . . . **114-*n*. In this regard, the link 112 may include a wired and/or wireless communication link between the server 110 and the one or more valve control modules 114-1, 114-2, . . . 114-*n*. In some implementations, the server 110 may include a waste system monitoring module 116. The waste system monitoring module 116 may be in communication with the valve control modules 114-1, 114-2, . . . 114-*n* to monitor the status of the corresponding valves 30-1, 30-2, . . . 30-*n* and/or waste-extracting valves 74-1, 74-2, . . . 74-*n*. The valve control module 114-1, 114-2, . . . 114-*n* may include a programmable microprocessor controller. In some implementations, the valve control module 114-1, 114-2, . . . 114-*n*** may include the MASTER-TROL WATER MANAGEMENT SYSTEM controller, manufactured by Acorn Engineering Company.

Figure 4:
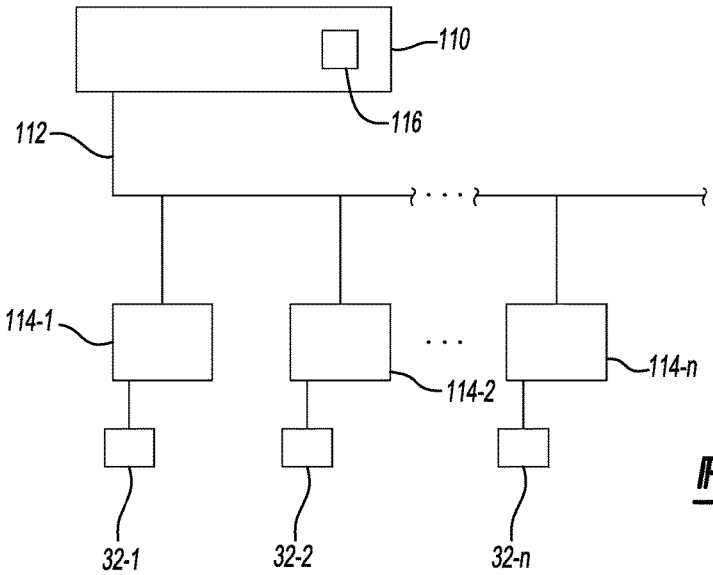
FIG. 4 is a functional block diagram of a waste receptacle control system in accordance with the principles of the present disclosure.
Figure 5:
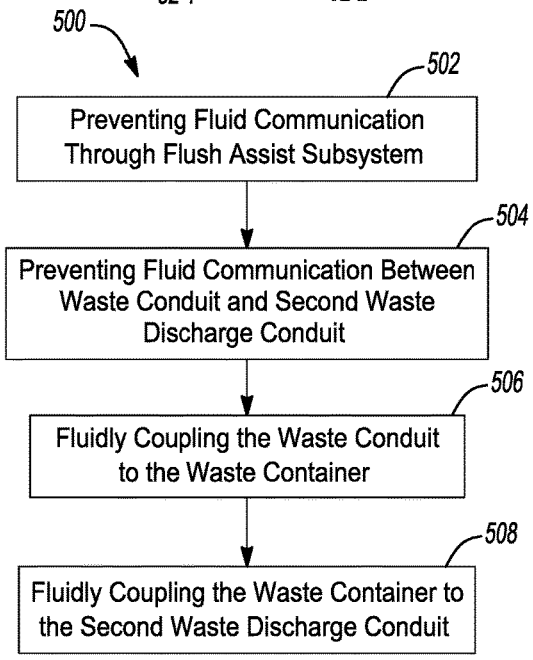
FIG. 5 is a flowchart illustrating a method of retrofitting a waste receptacle system in accordance with the principles of the present disclosure.

With reference to FIGS. 3-5, a method 500 of manufacturing the waste management system 14 will now be described. At 502, the method 500 may include preventing fluid communication between a portion of the fluid supply system 16 and the conveyance system 20. For example, at 502, the method 500 may include preventing fluid communication through the flush assist subsystem 46, **46*a*. In this regard, the method 500 may include preventing the flush assist subsystem 46, 46*a* from fluidly communicating with the waste conduit 44, 44*a*. In some implementations, the method may include installing the plug 64, 64*a* in one or more of the flush assist inlet 60, 60*a*, the waste conduit 58, 58*a*, and/or the flush assist outlet 62, 62*a*. For example, the method may include inserting the plug 64, 64*a* through the flush assist inlet 60, 60*a* and/or the flush assist outlet 62, 62*a* and sealingly engaging the plug 64, 64 with the inner surface 66, 66*a* of the waste conduit 58, 58*a***.

At 504, the method 500 may include preventing direct fluid communication between the waste conduit 44, **44*a* and the second waste discharge conduit 82. In this regard, at 504, the method 500 may include eliminating any fluid communication directly from the waste conduit 44, 44*a* to the second waste discharge conduit 82. For example, at 504, the method 500 may include decoupling the waste conduit 44, 44*a* from the second waste discharge conduit 82**.

At 506, the method 500 may include fluidly coupling the waste conduit 44, **44*a* to the waste container 76. For example, at 506, the method 500 may include coupling the conduit 68-*n* to the waste conduit 44, 44*a* and to the waste inlet 88 of the waste container 76**.

At 508, the method 500 may include fluidly coupling the waste container 76 to the second waste discharge conduit 82. For example, at 508, the method 500 may include coupling the first waste discharge conduit 78 to the waste outlet 90 of the waste container 76 and to the second waste discharge conduit 82. In certain implementations, the method 500 results in retrofitting one or more gravity waste disposal fixtures (e.g., toilets) into vacuum waste disposal fixtures, thereby resulting in reduced water usage. In this regard, at 508 the method 500 may include retrofitting one or more of the valves 30-1, 30-2, . . . **30-*n*, including replacing a valve cartridge (not shown) in one or more of the valves 30-1, 30-2, . . . 30-*n* with a low-volume fluid-supply valve cartridge. For example, the method 500 may include replacing one or more of the cartridges in the valves 30-1, 30-2, . . . 30-*n* with a valve cartridge operable to supply between 0.3 and 1.0 gallons of water per cycle. In some implementations, the method 500 may include replacing each of the cartridges in the valves 30-1, 30-2, . . . 30-*n*** with a valve cartridge operable to supply 0.75 gallons of water per flush cycle.

Figure 6:
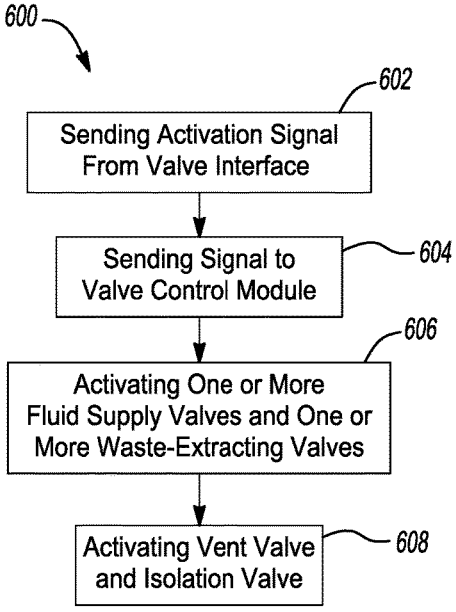
FIG. 6 is a flowchart illustrating an example of a method for controlling a waste receptacle system in accordance with the principles of the present disclosure.

With reference to FIGS. 4 and 6, a method 600 of operating the waste management system 14 will now be described. As will be explained in more detail below, the method of operating the waste management system 14 may include extracting the contents 108 from one or more of the toilets 34-1, 34-2, . . . **34-*n*, transporting the contents 108 through the conveyance system 20 (e.g., conduit 68-1, 68-2, . . . 68-*n*) to the waste container 76, and transporting the contents 108 from the waste container 76 to the second waste discharge conduit 82**.

At 602, the method may include sending an activation signal from one or more of the valve interfaces 32-1, 32-2, . . . **32-*n*. For example, at 604, the user may press a button or otherwise actuate one or more of the valve interfaces 32-1, 32-2, . . . 32-*n* in order to send an activation signal to a corresponding one or more of the valve control modules 114-1, 114-2, . . . 114-*n***.

At 604, the method may include sending a signal from one or more of the valve control modules 114-1, 114-2, . . . **114-*n* to a corresponding one or more of the valves 30-1, 30-2, . . . 30-*n* and/or a corresponding one or more of the waste-extracting valves 74-1, 74-2, . . . 74-*n* to activate, or otherwise control a position of, a corresponding one or more of the valves 30-1, 30-2, . . . 30-*n* and/or a corresponding one or more of the waste-extracting valves 74-1, 74-2, . . . 74-*n***.

At 606, the method may include simultaneously activating one or more of the valves 30-1, 30-2, . . . **30-*n* and/or a corresponding one or more of the waste-extracting valves 74-1, 74-2, . . . 74-*n*. In this regard, at 606, the method may include synchronizing the activation of one or more of the valves 30-1, 30-2, . . . 30-*n* with the activation of a corresponding one or more of the waste-extracting valves 74-1, 74-2, . . . 74-*n* in order to extract the contents 108 from the corresponding one or more of the toilets 34-1, 34-2, . . . 34-*n* and into the waste container 76. For example, the timing and duration of the activation at 606 of the one or more of the valves 30-1, 30-2, . . . 30-*n* may be the same as the timing and duration of the activation at 606 of the corresponding one or more of the waste-extracting valves 74-1, 74-2, . . . 74-*n*. In this regard, at 606, the server 110, including the waste system monitoring module 116, may communicate with the valve control modules 114-1, 114-2, . . . 114-*n* to monitor the position (e.g., open or closed), including the timing and/or duration of relative to the position, of the corresponding valves 30-1, 30-2, . . . 30-*n* and/or waste-extracting valves 74-1, 74-2, . . . 74-*n***.

At 608, the method may include activating the vent valve 104 in order to discharge the waste in the waste container 76 through the check valve 80 and the second waste discharge conduit 82. For example, at 608, the sensor 84 may detect and/or measure the amount of waste in the waste container 76. When the sensor 84 determines that the amount of waste in the waste container 76 exceeds a predetermined value, the sensor 84 may send a signal to the control system 24 to actuate (e.g., open) the vent valve 104 and actuate (e.g., close) the isolation valve 102. In some implementations, at 608, the sensor 84 may send a signal to the control system 24 to simultaneously actuate the vent valve 104 and the isolation valve 102. Upon opening the vent valve 104, the waste container 76 may be exposed to atmospheric pressure through the vacuum conduit 100 and the vent valve 104, such that gravity forces the waste in the container through the first waste discharge conduit 78 and through the check valve 80 into the second waste discharge conduit 82. In this regard, the predetermined amount of waste may be sufficient to provide a scouring action and create a high velocity of waste through the second discharge conduit 82. In some implementations, the predetermined amount of waste may be 10 gallons. In some implementations, at 608, the control system 24 may control a position (e.g., open or closed) of the check valve 80 to control the removal of waste from the waste container 76.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

Modules and data stores included in the waste management system 14 may be embodied by electronic hardware, software, firmware, or any combination thereof. Depiction of different features as separate modules and data stores does not necessarily imply whether the modules and data stores are embodied by common or separate electronic hardware or software components. In some implementations, the features associated with the one or more modules and data stores depicted herein may be realized by common electronic hardware and software components. In some implementations, the features associated with the one or more modules and data stores depicted herein may be realized by separate electronic hardware and software components.

The modules and data stores may be embodied by electronic hardware and software components including, but not limited to, one or more processing units, one or more memory components, one or more input/output (I/O) components, and interconnect components. Interconnect components may be configured to provide communication between the one or more processing units, the one or more memory components, and the one or more I/O components. For example, the interconnect components may include one or more buses that are configured to transfer data between electronic components. The interconnect components may also include control circuits (e.g., a memory controller and/or an I/O controller) that are configured to control communication between electronic components.

Various implementations of the systems and techniques described herein can be realized in digital electronic and/or optical circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, non-transitory computer readable medium, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

The processes and logic flows described in this specification can be performed by one or more programmable processors executing one or more computer programs to perform functions by operating on input data and generating output. The processes and logic flows can also be performed by special purpose logic circuitry, e.g., an FPGA (field programmable gate array) or an ASIC (application specific integrated circuit). Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, one or more aspects of the disclosure can be implemented on a computer having a display device, e.g., a CRT (cathode ray tube), LCD (liquid crystal display) monitor, or touch screen for displaying information to the user and optionally a keyboard and a pointing device, e.g., a mouse or a trackball, by which the user can provide input to the computer. Other kinds of devices can be used to provide interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

What is claimed is:

1. A toilet assembly comprising:

a toilet bowl;

a fluid inlet in continuous fluid communication with the toilet bowl;

a waste conduit in fluid communication with the inlet through the toilet bowl;

a flush valve coupled to the fluid inlet and configured to supply water to the fluid inlet;

a flush-assist subsystem extending between the fluid inlet and waste conduit, the flush-assist subsystem having a flush-assist inlet and a flush-assist outlet connected together by a flush assist conduit, the flush-assist inlet being directly connect to the fluid inlet downstream of the valve, the flush-assist outlet being directly connected to the waste conduit; and a non-actuatable plug disposed within the flush-assist subsystem and configured to prevent fluid communication between the inlet conduit and the waste conduit through the flush-assist subsystem.

2. The toilet assembly of claim 1, wherein the flush-assist conduit has an inner surface.

3. The toilet assembly of claim 2, wherein the plug is sealingly engaged with the inner surface.

4. The toilet assembly of claim 1, wherein the plug includes at least one of metal, elastomer, ceramic, mortar, and plaster.

5. The toilet assembly of claim 1, wherein the plug is disposed proximate the flush-assist inlet.

6. The toilet assembly of claim 1, wherein the plug is disposed proximate the flush-assist outlet.

7. The toilet assembly of claim 1, wherein the toilet bowl includes an outlet port in fluid communication with the waste conduit, the flush-assist outlet being disposed downstream of the outlet port.

8. The toilet assembly of claim 1, wherein the toilet bowl includes an outlet port in fluid communication with the waste conduit, the flush-assist outlet being disposed upstream of the outlet port.

9. The toilet assembly of claim 1, wherein the plug is removably disposed within the flush-assist subsystem.

10. A vacuum plumbing system comprising:

a vacuum pump;

a waste discharge conduit;

a waste container in fluid communication with the vacuum pump and the waste discharge conduit;

a water supply conduit; and a valve associated with the water supply conduit and configured to supply water from the water supply conduit to a fluid inlet in continuous fluid communication with a toilet bowl of a toilet, the toilet further comprising a waste conduit in fluid communication with the fluid inlet through the toilet bowl and in fluid communication with the waste container;

a flush-assist conduit having a flush-assist inlet and a flush-assist outlet, the flush-assist conduit extending between the fluid inlet and the waste discharge conduit, the flush-assist inlet being in open fluid communication with the inlet conduit downstream of the valve, the flush-assist outlet being in fluid communication with the waste conduit; and a non-actuatable plug disposed within the flush-assist conduit and occluding fluid communication between the inlet conduit and the waste conduit through the flush-assist conduit.

11. The vacuum plumbing system of claim 10, wherein the plug includes at least one of metal, elastomer, ceramic, mortar, and plaster.

12. The vacuum plumbing system of claim 10, wherein the plug is disposed proximate one of the flush-assist inlet and the flush-assist outlet.

13. The vacuum plumbing system of claim 10, wherein the toilet bowl includes an outlet port in fluid communication with the waste conduit, the flush-assist outlet being disposed downstream of the outlet port.

14. The vacuum plumbing system of claim 10, wherein the toilet bowl includes an outlet port in fluid communication with the waste conduit, the flush-assist outlet being disposed upstream of the outlet port.

15. The vacuum plumbing system of claim 10, wherein the plug is removably disposed within the flush-assist subsystem.

16. A method of retrofitting a toilet, the method comprising:

providing a toilet having a toilet bowl in continuous fluid communication with a fluid inlet coupled to a valve configured to provide water to the fluid inlet, a fluid outlet in fluid communication with the fluid inlet through the toilet bowl, and a flush-assist subsystem extending between the fluid inlet and the fluid outlet, the flush-assist subsystem having flush-assist conduit with a flush-assist inlet and a flush-assist outlet, the flush-assist inlet being in direct fluid communication with the fluid inlet downstream of the valve and the flush assist outlet being in direct fluid communication with the fluid outlet, and preventing fluid communication between the flush-assist inlet and the fluid outlet through the flush assist conduit by inserting a non-actuatable plug within the flush-assist subsystem.

17. The method of claim 16, further comprising disconnecting the fluid outlet from a waste discharge conduit connected to the toilet bowl.

18. The method of claim 17, further comprising fluidly connecting the fluid outlet to a waste container.

19. The method of claim 18, further comprising fluidly connecting the waste container to the waste discharge conduit that was previously disconnected.

* * * * *